US007556261B2

(12) United States Patent
Luquet et al.

(10) Patent No.: US 7,556,261 B2
(45) Date of Patent: Jul. 7, 2009

(54) DEVICE FOR RECEIVING ENVELOPES

(75) Inventors: Jean-Laurent Luquet, Gif sur Yvette (FR); Philip Torres, Fontenay Aux Roses (FR)

(73) Assignee: NEOPOST Technologies, Bagneux (FR)

( * ) Notice: Subject to any disclaimer, the term of this patent is extended or adjusted under 35 U.S.C. 154(b) by 75 days.

(21) Appl. No.: 10/767,125

(22) Filed: Jan. 29, 2004

(65) Prior Publication Data

US 2005/0017439 A1 Jan. 27, 2005

(30) Foreign Application Priority Data

Jan. 30, 2003 (FR) ..... 03 01042

(51) Int. Cl.
*B65H 3/00* (2006.01)

(52) U.S. Cl. ..... 271/207

(58) Field of Classification Search ..... 271/2, 271/207; 193/8; 270/58.06; 399/405; 403/187, 403/188

See application file for complete search history.

(56) References Cited

U.S. PATENT DOCUMENTS

| | | | | | |
|---|---|---|---|---|---|
| 2,166,916 | A | * | 7/1939 | Lombard | 248/73 |
| D167,393 | S | * | 8/1952 | Davis | D18/49 |
| 2,963,761 | A | * | 12/1960 | Haydock | 403/188 |
| 3,154,356 | A | * | 10/1964 | Lewis et al. | 271/207 |
| 3,387,343 | A | * | 6/1968 | Fitsz-Gerald | 403/188 |
| 3,521,332 | A | * | 7/1970 | Kramer | 403/188 |
| 3,612,515 | A | * | 10/1971 | Bergeson | 271/208 |
| 3,747,166 | A | * | 7/1973 | Eross | 248/75 |
| 4,114,241 | A | * | 9/1978 | Bisping | 403/188 |
| 4,155,643 | A | | 5/1979 | Ladds et al. | |
| 4,300,757 | A | * | 11/1981 | Koiso et al. | 271/207 |
| 4,667,949 | A | | 5/1987 | Goodwin et al. | |
| 4,707,892 | A | * | 11/1987 | Nelson | 24/336 |
| 5,018,623 | A | * | 5/1991 | Hrenyo | 206/557 |
| 5,363,998 | A | * | 11/1994 | Tschiderer | 226/200 |
| 5,454,553 | A | * | 10/1995 | Firl et al. | 271/4.04 |
| 5,484,140 | A | * | 1/1996 | Hirose et al. | 271/175 |
| 5,603,683 | A | | 2/1997 | Lee et al. | |
| 5,913,628 | A | * | 6/1999 | Sides, II | 400/679 |
| 6,226,959 | B1 | * | 5/2001 | Krasuski et al. | 53/117 |
| D482,366 | S | * | 11/2003 | Rowell | D14/471 |
| 6,714,326 | B1 | * | 3/2004 | Yamada | 358/498 |
| 2002/0140161 | A1 | | 10/2002 | Schneider et al. | |
| 2005/0275157 | A1 | * | 12/2005 | Mindler et al. | 271/207 |

FOREIGN PATENT DOCUMENTS

| | | | |
|---|---|---|---|
| EP | 237026 | A1 * | 9/1987 |
| JP | 08337349 | A * | 12/1996 |

* cited by examiner

*Primary Examiner*—Patrick H Mackey
*Assistant Examiner*—Jeremy Severson
(74) *Attorney, Agent, or Firm*—Sughrue Mion, PLLC

(57) ABSTRACT

This invention relates to a mail item receiving device for receiving the mail items ejected through an exit slot of a folding and inserting machine, comprising a support plate on which the ejected mail items will accumulate, a front wall on which these mail items will abut upon their ejection, two lateral walls and a rear wall intended to align these mail items once they have fallen on the support plate, said support plate comprising two hollows made on either side of its longitudinal axis at the level of its join with said front wall, the two lateral walls each comprising an opening, at the level of each hollow and over the whole of their height, and the rear wall comprises hooking means for connecting the receiving device to the folding and inserting machine.

8 Claims, 2 Drawing Sheets

DEVICE FOR RECEIVING ENVELOPES

This application claims benefit of the earlier filed French Application No. 03 01042, filed Jan. 30, 2003.

FIELD OF THE INVENTION

The present invention relates to the domain of mail handling and more particularly to an envelope-receiving device for a machine for folding and inserting documents.

BACKGROUND OF THE INVENTION

Folding and inserting machines conventionally comprise three principal elements: an empty envelope feeder, a feeder of documents having to be inserted into these envelopes, a station for folding these documents incorporating one or more folders and a station for inserting the folded documents into the empty envelopes. At the close of the folding and inserting process, the envelopes, which are or are not closed (depending on whether the machine comprises an internal sealing module), are ejected through an exit slot of the machine into a receiving device arranged at the exit of this machine and intended to receive these envelopes. At the present time, these machines can handle mail items of any type and any format and the receiving device must therefore be able to receive and store all these mail items correctly. This is why these devices are mostly constituted by a simple tray in which the mail items of all formats are stored flat and in bulk in a stack of low capacity (about 100 to 200 envelopes of average thickness), as they are being handled.

Unfortunately, this tray is often poorly adapted to the folding and inserting machine and, once full, it is difficult to remove the mail items therefrom without taking hold of the tray itself.

When the receiving device is fixed to the machine, it is most often done so by fixation means whose installation requires that the machine be lifted at least partly, which may be the cause of accidents.

It is an object of the present invention to overcome these drawbacks by proposing a receiving device which is compact (i.e. with reduced space requirement) and ergonomic, particularly adapted to a folding and inserting machine and which does not require to be withdrawn in order to extract the mail items that it contains therefrom. Another object of the invention is to propose a device which is simple to fix to the machine and which does not necessitate any structural modification of the latter.

SUMMARY OF THE INVENTION

These objects are attained by a mail item receiving device for receiving the mail items ejected through an exit slot of a folding and inserting machine, comprising a support plate on which the ejected mail items will accumulate, a front wall on which these mail items will abut upon their ejection, two lateral walls and a rear wall intended to align these mail items once they have fallen on the support plate, that said support plate comprising two hollows made on either side of its longitudinal axis at the level of its join with said front wall, said two lateral walls each comprising an opening, at the level of each hollow and over the whole of their height, characterized in that said rear wall comprises hooking means for connecting the receiving device to the folding and inserting machine.

With this configuration, positioning of the device is thus simple and rapid and the envelopes are likewise withdrawn very simply without having to touch the receiving tray.

The hooking means preferably comprise two clips intended to cooperate with the front feet of the machine. The centering ensured by the fixing clips thus guarantees a perfect ejection of the envelopes.

In order to avoid any risk of injury, the lateral walls each present an outer corner without sharp angle.

In order to ensure solidity of the device, the rear wall integrating the hooking means is reinforced by ribs.

The device is advantageously made by moulding plastics material in one piece and the lateral walls and the front wall are made of a transparent material.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 2:
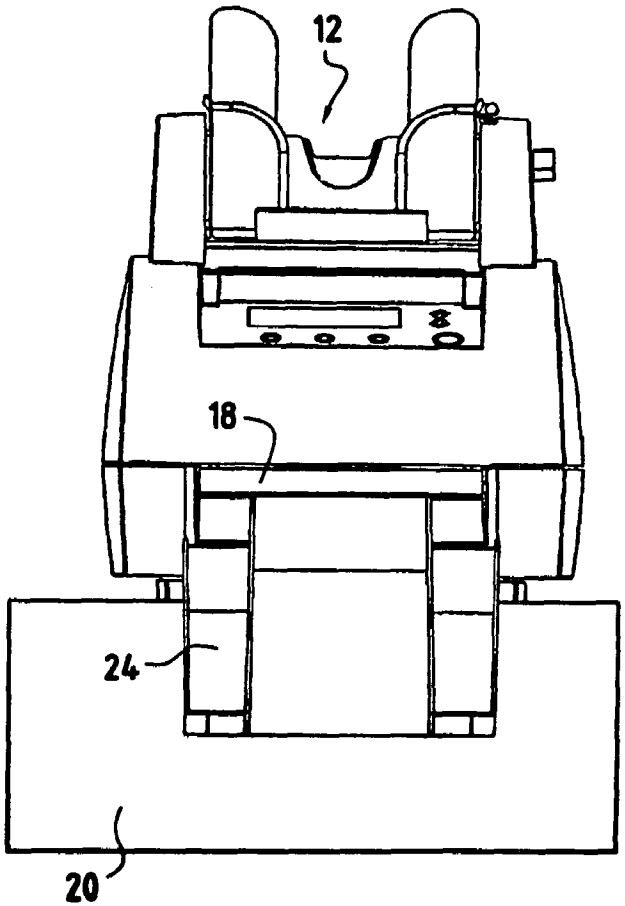
FIGS. 1 and 2 illustrate in side and front view a folding and inserting machine comprising a receiving device according to the invention.
Figure 1:
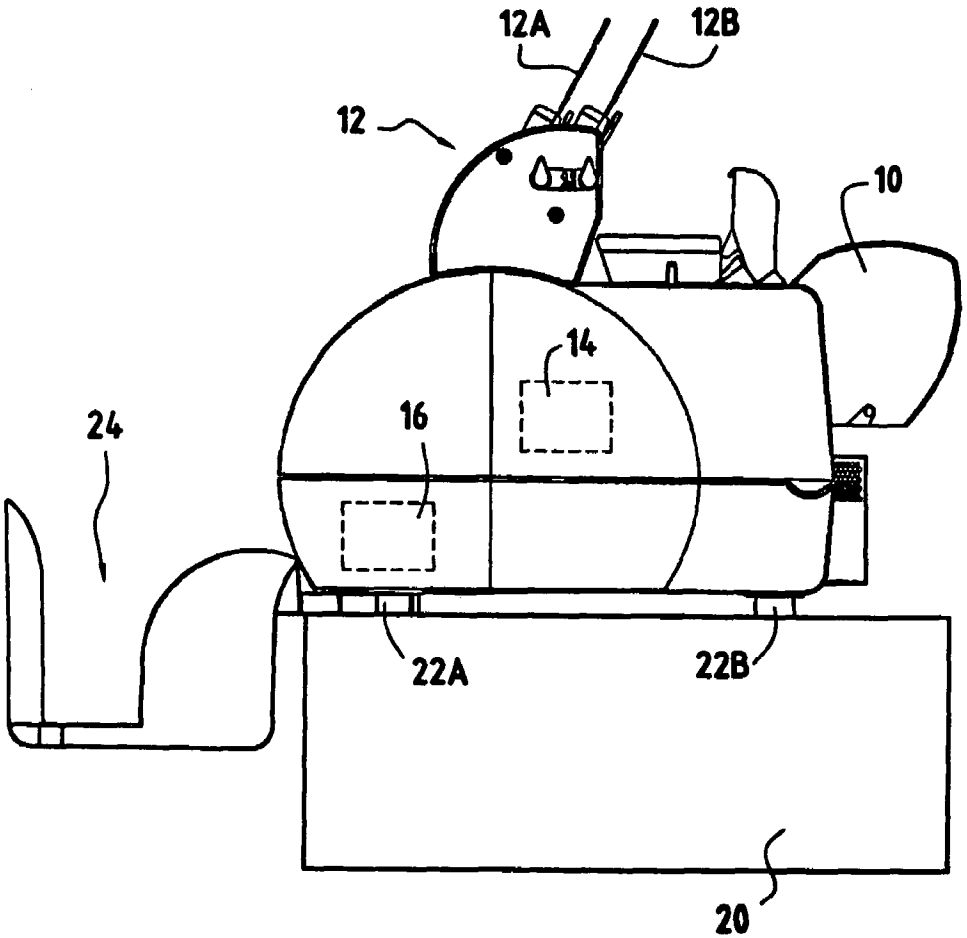

Referring now to the drawings, a folding and inserting machine as illustrated in FIGS. 1 and 2 conventionally comprises: an empty-envelope feeder 10, a document feeder 12 which may comprise one or more automatic feed bins 12A, 12B, a document folding station 14 comprising one or more folders and a document insertion station 16 intended to insert the documents thus folded into an empty envelope issuing from the feeder 10. This insertion station may possibly be followed by a sealing station (not shown) for closing the envelopes thus filled. The closed envelopes are then ejected via an exit slot 18 located on a front face of the folding and inserting machine. This machine rests on a work table 20 via four front (22A) and rear (22B) feet which are advantageously adjustable in height, and it is most often arranged on an edge of this table in order to be easily available for an operator in charge of working it, who is generally posted in front of this table.

Figure 4:
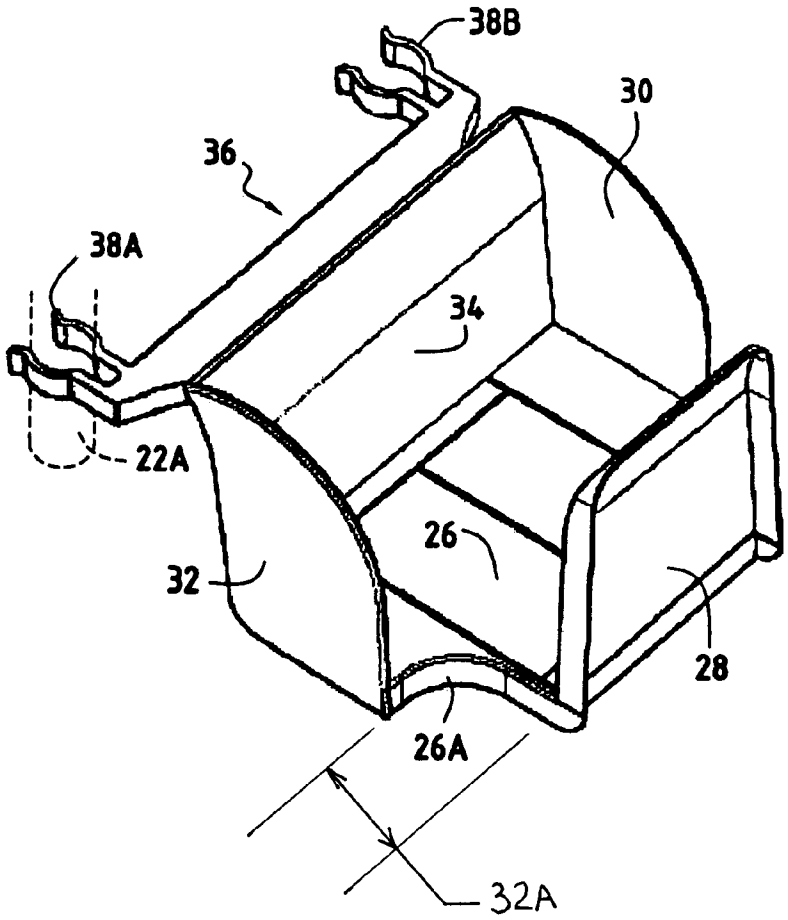
FIGS. 3 and 4 are two views in front and rear perspective of the receiving device of FIGS. 1 and 2.
Figure 3:
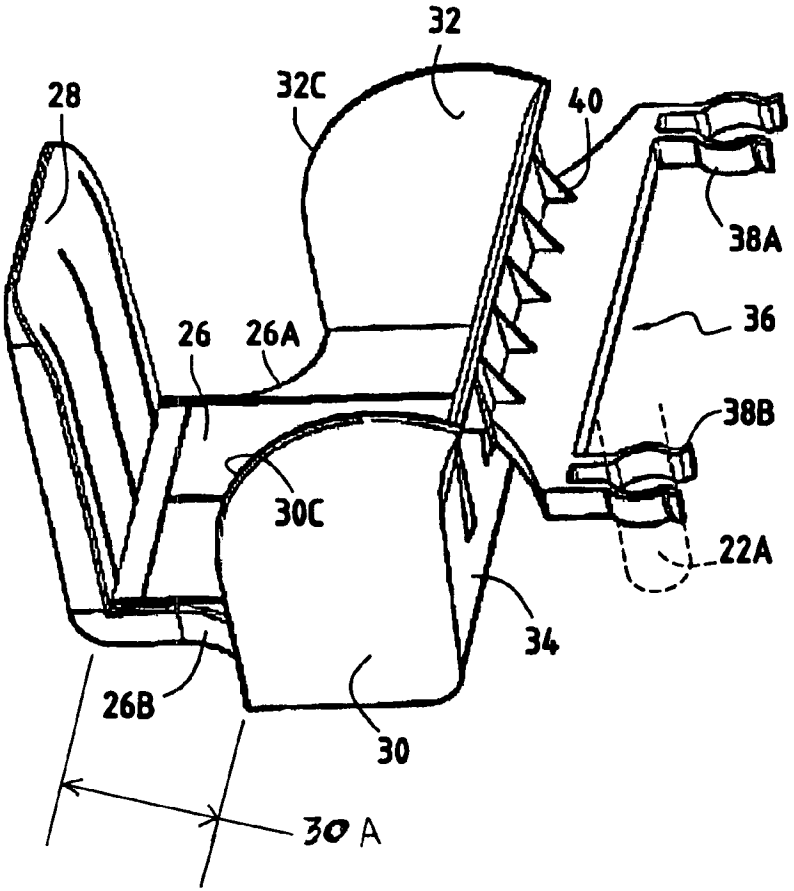

According to the invention, this machine is provided with a specific one-piece device 24 for receiving the mail items, intended to receive the mail items ejected via its exit slot, one after the other. A form of embodiment of such a mail item receiving device especially adapted for a folding and inserting machine is illustrated in FIGS. 3 and 4.

The receiving device in the form of a parallelepipedic tray conventionally comprises a support plate 26 on which the ejected mail items will accumulate, a front wall 28 on which these mail items will abut upon ejection, two lateral walls 30, 32 and a rear or bottom wall 34 intended to align these mail items once they have fallen on the support plate.

However, according to the invention, in order to allow the operator to seize the mail items particularly easily once the tray is full, the support plate 26 comprises two hollows 26A, 26B made on either side of its longitudinal axis at the level of its join with the front wall 28 so that this front wall presents a width smaller than that of the rear wall 34, the two lateral walls each comprising an opening 30A, 32A at the level of this hollow and over the whole of their height. The lateral walls advantageously each present at the level of this opening an outer corner 30C, 32C without sharp angle, and preferably rounded in order to avoid any risk of injury when the mail items are being seized.

In order to ensure a perfect connection of the receiving device to the folding and inserting machine, the rear wall 34 comprises hooking means 36 advantageously constituted by two clips 38A, 38B intended to fit directly on the front feet 22A of the machine. The device is thus perfectly centered on the exit slot 18 of the machine and, thanks to this connection, it cannot move under the effect of the ejection of the mail items which, coming into abutment against its front wall, might tend to cause the device to move away.

The receiving device is advantageously made by moulding plastics material in one piece. It is thus very easy to maintain. The lateral walls and the front wall are preferably made of a transparent material. In addition, the slight elasticity of the clips allows the device to be easily removed in the event of maintenance of the machine, for example.

The device being mounted in a position below the level of ejection of the folding and inserting machine, it may, if the feet 22 are not sufficiently high, as shown in FIG. 1, be arranged in overhang with respect to this machine and thus be subjected to certain bending stresses. The rear wall 34 integrating the hooking means is thus advantageously reinforced by ribs or stiffeners 40 in order to improve the solidity thereof.

The ease of unloading the device is particularly appreciated, as well as its reduced space requirement. In addition, the operator can unload very simply without, for example, having to hold the device while withdrawing the mail items.

What is claimed is:

1. A mail item receiving device comprising:

a support plate on which ejected mail items will accumulate, a front wall, joined to the support plate, on which these mail items will abut upon their ejection, two lateral walls joined to the support plate, and a rear wall, joined to the support plate and two lateral walls, configured to align these mail items once they have fallen on the support plate, wherein the mail item receiving device is configured to receive the ejected mail items from a folding and inserting machine and said support plate includes two hollows provided on either side of its longitudinal axis at a level at which the support plate is joined with said front wall, and wherein each hollow creates an opening between a respective lateral wall and the front wall and said rear wall comprises hooking means configured to cooperate with feet of a folding and inserting machine for connecting the receiving device to the folding and inserting machine.

2. The device of claim 1, wherein said hooking means comprise two clips which respectively clip on to two front feet of the machine.

3. The device of claim 1, wherein said lateral walls each present an outer corner without sharp angle.

4. The device of claim 1, wherein said rear wall integrating the hooking means is reinforced by ribs.

5. The device of claim 1, wherein the device is made by moulding plastics material in one piece.

6. The device of claim 5, wherein said lateral walls and the front wall are made of a transparent material.

7. The device of claim 1, wherein each opening allows items received on the support plate to be accessed through the opening.

8. The device of claim 1, wherein each of the lateral walls further comprises a rounded corner located opposite the support plate and rear wall.

* * * * *